US006071475A

United States Patent [19]

Schmidt et al.

[11] Patent Number: 6,071,475

[45] Date of Patent: Jun. 6, 2000

[54] PROCESS OF PRESERVING PAPER

[75] Inventors: Helmut Schmidt, Saarbrücken-Güdingen; Reiner Kasemann, Glonn; Stefan Sepeur, Wadgassen; Helmut Duddeck, Bochum, all of Germany

[73] Assignee: Institut für Neue Materialien Gemeinnützige, Saarbrücken, Germany

[21] Appl. No.: 09/068,905

[22] PCT Filed: Nov. 22, 1996

[86] PCT No.: PCT/EP96/05176

§ 371 Date: May 21, 1998

§ 102(e) Date: May 21, 1998

[87] PCT Pub. No.: WO97/19224

PCT Pub. Date: May 29, 1997

[30] Foreign Application Priority Data

Nov. 23, 1995 [DE] Germany ..... 195 43 707

[51] Int. Cl.[7] ..... D21H 25/18

[52] U.S. Cl. ..... 422/40; 162/135; 528/43

[58] Field of Search ..... 162/135, 136, 162/158, 160, 164.1; 422/40, 28; 528/43, 10, 32

[56] References Cited

U.S. PATENT DOCUMENTS 5,482,781 1/1996 Wittekind et al. ..... 428/537.5

5,644,014 7/1997 Schmidt et al. ..... 528/43

FOREIGN PATENT DOCUMENTS

92/21729 12/1992 WIPO .

*Primary Examiner*—Elizabeth McKane

*Attorney, Agent, or Firm*—Heller, Ehrman White & McAuliffe

[57] ABSTRACT

A process is disclosed for preserving paper involving the following steps:

(a) a plurality of paper layers in contact with one another at least in regions is simultaneously brought into contact with a preservative fluid containing polycondensates based on one or more hydrolytic polycondensation-capable compounds of elements M of main groups III–V and sub-groups II–IV of the Periodic Table; in said polycondensates, at least one organic group (G) with at least two carbon atoms and for each carbon atom at least one atom selected from hydrogen or fluorine and without polar substituents is bound, either directly via one of the carbon atoms or via a connecting group A, to at least 0.1% of the central atoms M; and (b) the paper thus treated with the preservative fluid is dried and/or hardened.

25 Claims, No Drawings

PROCESS OF PRESERVING PAPER

Although the public is little aware of the destruction and degradation, respectively, of paper, caused not least by environmental influences, it is a fact that said degradation of paper gives rise to losses in the order of billions per year worldwide, not to mention that thereby in part also material which is valuable from a cultural and historical point of view gets lost forever. The main reason for that is the presence therein of sulfuric acid caused by the paper manufacturing process, which presence results in a slow but steadily proceeding catalytic hydrolysis of the cellulose skeleton.

There actually are deacidification processes by which said destruction of paper can be slowed down or concealed, but said processes, although arresting the degradation, do not result in a reinforcement. In order to achieve reinforcement (consolidation), each sheet (e.g., of a book) must be treated individually. This is why the processes employed for said purpose so far are laborious and in addition of only limited effectiveness.

Therefore there is an urgent need for a process with which paper and paper products, respectively, particularly (valuable) books, ancient (historic) writings (e.g. documents, maps etc.) but also pieces of art (drawings, etchings, ink paintings, reproductions etc.) and products of the press which are subject to intensive use (e.g. books in libraries, bills) can simply and efficiently be deacidified and at the same time reinforced (in the following globally referred to as "preserved"). Although on principle said reinforcement can be achieved by impregnation with organic polymerizable monomers and subsequent polymerization thereof, leaves, e.g. of a book, in contact with each other will irreversibly stick together as a result thereof. The object of the present invention thus in particular is to provide a process which by a simple impregnation of paper results in a simultaneous deacidification and reinforcement thereof without causing paper layers in contact with each other to stick together.

Surprisingly it has been found that the above object can be achieved by a process for preserving paper, which comprises (a) simultaneous contacting of a plurality of paper layers (e.g. sheets, leaves or webs) which are at least in part in contact with each other with a preservative fluid comprising polycondensates based on one or more hydrolytically polycondensable compounds of elements M of the main groups III to V and the sub-groups II to IV of the Periodic Table, wherein in said polycondensates an organic group G which comprises at least two carbon atoms to each of which at least one atom selected from hydrogen and fluorine atoms is bonded and which does not have any polar substituents, is bonded, either directly via one of said carbon atoms or via a linking group A, to at least 0.1% of the central atoms M; and (b) drying and/or curing of the paper treated with said preservative fluid.

In the present invention the term "paper" is to denote products based on felted plant fibers, particularly based on cellulose, wood pulp, straw cellullose, rag cellulose and recycled paper pulp. Said term includes for example graphic papers (e.g. papers for writing and printing). Of course, other products such as Kraft paper, cardboard and paperboard may also be treated by the present process although in the latter cases an effective preservation will in most cases not be necessary.

The above elements M from the main groups III to V and the sub-groups II to IV of the Periodic Table include, e.g., at least one element selected from silicon, aluminum, boron, tin, zirconium, vanadium and zinc, Si, Al and Zr being preferred. In particular, preferably 75% to 100% and particularly preferred 90% to 100% of all central atoms of the polycondensates present in the coating composition are silicon, aluminum and/or zirconium atoms.

According to the present invention organic groups G which feature at least 2 (and preferably at least 3 and particularly at least 5) carbon atoms to each of which at least one and preferably at least two atoms selected from hydrogen and fluorine atoms are bonded and which do not have any polar substituents are bonded to at least 0.1% (preferably at least 0.5% and particularly at least 1%) of all central atoms M present in the above polycondensates. Preferably said groups G are aliphatic groups, particularly alkyl and/or alkenyl groups, which may optionally be partially fluorinated. Said groups may, e.g., be those of long-chain, saturated or unsaturated fatty acids such as palmitic acid, stearic acid, oleic acid, linolic acid, linolenic acid etc. Said chains may have been introduced into said polycondensates, by e.g. chelating of the corresponding acid and a hydrolyzable starting compound, e.g. of Al or Zr. In that case the above linking group A thus is a chelating group which results in the structure

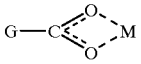

Examples of said partially fluorinated groups G which can be employed according to the present invention (and also are preferred according to the present invention) are groups having aliphatic carbon atoms to which a total of 2 to 30 (preferably 3 to 25, more preferred 5 to 20 and particularly preferred 8 to 18) fluorine atoms are bonded and which (at least in the case of the direct bonding of G to M) are each separated by at least two atoms (preferably carbon atoms) from the central atom M.

The above number of fluorine atoms bonded to aliphatic carbon atoms does not include those fluorine atoms which optionally may be bonded in a different manner, e.g. to aromatic carbon atoms (such as in the case of $C_6F_4$). The fluorine-containing group may also be a chelating ligand. It is also possible for one or more fluorine atoms to be present on a carbon atom from which a double or triple bond originates. Particularly in view of the availability of the corresponding starting materials (i.e. of the (partially) hydrolyzable compounds of the elements M) fluorine-containing, non-hydrolyzable groups which are preferably bonded to silicon atoms are preferred. Specific examples of such fluorine-containing, non-hydrolyzable groups are: $CF_3CH_2CH_2$—, $C_2F_5CH_2CH_2$—, $C_4F_9CH_2CH_2$—, n—$C_6F_{13}CH_2CH_2$—, n—$C_8F_{17}CH_2CH_2$—, n—$C_{10}F_{21}CH_2CH_2$— and i—$C_3F_7O$—$(CH_2)_3$—.

Among said groups n—$C_6F_{13}CH_2CH_2$—, n—$C_8F_{17}CH_2CH_2$— and n—$C_{10}F_{21}CH_2CH_2$— are particularly preferred. According to the present invention it is, of course, also possible to employ other fluorine-containing groups G as well as mixtures of different fluorine-containing groups G.

Fluorine-containing polycondensates as employable according to the present invention as well as the preparation thereof are described in detail in WO 92/21729 (EP-A-587667). The entire disclosure of said application is therefore specifically referred to herein. Said application also discloses specific compounds which are suitable for the preparation of the polycondensates employed according to the present invention, particularly compounds of Si, Al and Zr.

It is preferred that at least one (e.g. one or two) non-hydrolyzable or non-hydrolyzing, respectively, organic group, including the above groups G, is present on at least 25% of the central atoms M of the polycondensates. The term "non-hydrolyzing" in the present context denotes a group which on principle is susceptible to hydrolysis but in fact does not hydrolyze under the given conditions in the preparation of the polycondensates, the treatment of the paper and the subsequent drying and/or curing operation. Examples of the latter groups may, for example, also comprise the above chelating groups A. Preferably, one or two (preferably one) non-hydrolyzable or non-hydrolyzing, respectively, groups are bonded to 50% to 100% and particularly 75% to 100% of the central atoms M in the polycondensates. Said groups may be selected from, e.g., alkyl (particularly $C_{1-4}$ alkyl such as methyl, ethyl, propyl and butyl), alkenyl (particularly $C_{2-4}$ alkenyl such as vinyl, 1-propenyl, 2-propenyl and butenyl), alkynyl (particularly $C_{2-4}$ alkynyl such as ethynyl and propynyl), and aryl (particularly $C_{6-10}$ aryl such as phenyl and naphthyl), the just mentined groups or at least those different from groups G optionally having one or more substituents such as chlorine, bromine, hydroxy, alkoxy, epoxy (optionally substituted) amino etc. The above alkyl radicals include the corresponding cyclic and aryl-substituted radicals such as cyclohexyl and benzyl whereras the alkenyl and alkynyl groups may also be cyclic and the mentioned aryl groups also are to include alkaryl groups (such as tolyl and xylyl). Particularly preferred groups are groups H' which feature an (optionally multiply) unsaturated carbon-carbon bond and/or have a highly reactive functional group such, e.g., epoxy. Among the unsaturated groups those groups which have a (meth) acryloxy radical (particularly a (meth)acryloxy $C_{1-4}$ alkyl radical such as (meth)acryloxypropyl) deserve particular mentioning. The presence of such groups in the corresponding polycondensates is advantageous in that after the treatment of the paper with the preservative fluid a double curing can be effected, i.e., a thermally or photochemically induced linking of the unsaturated organic radicals by (radical) polymerization (or, in the case of epoxide rings, by ring-opening polymerization) and a thermal completion of the polycondensation (e.g. by cleaving off water from M—OH-groups still present).

According to the present invention it is thus preferred for 1% to 100%, particularly 5% to 85% and particularly preferred 20% to 70% by moles of the non-hydrolyzable or non-hydrolyzing, respectively, organic groups (including the groups G) to have at least one carbon-carbon double or triple bond and/or an epoxide ring.

The (partially) hydrolyzable starting compounds used for the preparation of the preservative fluid and the polycondensates, respectively, employed according to the present invention are those of elements of the main groups III to V and the sub-groups II to IV of the Periodic Table. Other hydrolyzable compounds may, of course, be additionally be employed, particularly those of elements of the main groups I and II of the Periodic Table (e.g. Na, K, Ca and Mg) and of the sub-groups V to VIII of the Periodic Table. It is, however, preferred that the just mentioned compounds do not account for more than 10% and particularly not more than 5% by moles of the total of hydrolyzable monomeric compounds employed.

Examples of hydrolyzable groups in the starting compounds (which starting compounds are not necessarily employed as monomeric compounds but may already be in the form of corresponding precondensates of compounds of one or more of said elements M) are—in part dependent on the central atom M—halogen (F, Cl, Br and I, particularly Cl and Br), alkoxy (particularly $C_{1-4}$ alkoxy such as methoxy, ethoxy, n-propoxy, i-propoxy and butoxy), aryloxy (particularly $C_{6-10}$ aryloxy, e.g. phenoxy), acyloxy (particularly $C_{1-4}$ acyloxy such as acetoxy and propionyloxy) and acyl (e.g. acetyl).

Apart from the just mentioned hydrolyzable groups hydrogen and alkoxy radicals having 5 to 20, particularly 5 to 10 carbon atoms and halogen- and alkoxy-substituted alkoxy groups (e.g. β-methoxyethoxy) may be mentioned as further groups which are also suitable.

Since the hydrolyzable groups will not be present any more in the preserved paper but will get lost by hydrolysis (and condensation), it also being possibly necessary to remove the products of hydrolysis sooner or later in any suitable manner (particularly if such a hydrolysis product in the preservative fluid according to the present invention would adversely affect the paper to be preserved or components thereof), those hydrolyzable groups which do not carry any substituents and result in low molecular weight hydrolysis products such as, e.g., lower alcohols like methanol, ethanol, propanol and butanol are particularly preferred. The last-mentioned hydrolyzable groups are preferred also because they substantially do not influence the pH value in the hydrolysis (in contrast to, for example, halogen).

In addition to the above-described polycondensates and optionally water and hydrolysis products from the hydrolysis of the starting compounds other components may also be present in the preservative fluid employed according to the present invention, which components must, of course, not adversely affect the paper to be preserved or the components thereof, respectively (such as sizing agents, fillers, dyes, resins etc.) and the materials applied onto the paper (e.g. printing ink, ink, graphite etc.).

Thus the preservative fluid employed according to the present invention will, in most cases, contain a solvent for adjusting the viscosity of the preservative fluid. Said solvent can be water and/or organic solvents. Among said organic solvents the lower alcohols such as methanol, ethanol, propanol and the butanols are to be mentioned particularly since said alcohols are usually formed as by-products of the polycondensation reaction when using the preferred starting materials (see above). It is, of course, also possible to employ mixtures of solvents, e.g. mixtures of the by-products formed by the hydrolysis reaction (e.g. alcohols) and other (preferably readily volatile) solvents such as ethers, ketones, esters and (aliphatic or aromatic) hydrocarbons. The total solids content of the preservative fluid employed according to the present invention usually is 10% to 75%, preferably 15% to 50% and particularly preferred 20% to 40% by weight.

Especially in the case where at least a part of the non-hydrolyzable or non-hydrolyzing, respectively organic groups bonded to central atoms M feature reactive multiple bonds and/or other reactive groups (e.g. epoxide rings) the preservative fluid may also contain compounds which are capable of reacting with such groups or groupings in a thermally or photochemically induced reaction. For example, in the case of the presence of non-hydrolyzable or non-hydrolyzing, respectively organic groups having carbon-carbon double or triple bonds (such as (meth) acryloxyalkyl groups) it may thus prove expedient to add to said preservative fluid organic unsaturated compounds which can then copolymerize with said unsaturated groups of the polycondensates. Examples of such unsaturated organic compounds are styrene, acrylic acid, methacrylic acid or corresponding derivatives (e.g. esters, amides, nitriles) of the just mentioned acids. Such compounds may also be partially or completely fluorinated. It is also possible to employ compounds featuring (per)fluorinated groups which will react during the preparation of the preservative fluid and the polycondensates, respectively with non-hydrolyzable and non-hydrolyzing, respectively non-fluorinated groups to thereby afford fluorinated groups (e.g. by reaction of S—H- or N—H-groups with hexafluoropropene oxide).

Furthermore, for example in the case of the presence of epoxide containing organic groups on central atoms M, the preservative fluid may contain compounds capable of undergoing a (catalytic) ring-opening polymerization with epoxide rings, such as hydroxyl and amino group containing compounds (e.g. phenols).

The addition of the above-mentioned organic compounds capable of reacting with organic groups present on the central atoms M of the polycondensates employed according to the present invention makes it possible to adjust the properties of the resultant impregnation to the specific circumstances (kind and nature of the paper to be preserved, etc.).

Particularly if organic groups having unsaturated carbon-carbon bonds are among the organic groups in the polycondensates of the preservative fluid employed according to the present invention, said preservative fluid preferably also contains a catalyst for the thermally and/or photochemically induced curing of the polycondensates applied onto the paper. Thus a photopolymerization initiator may, for example, be added. As photoinitiators the commercially available ones may, for example, be employed. Examples thereof are Irgacure®184 (1-hydroxycyclohexylphenylketone), Irgacure®500 (1-hydroxycyclohexylphenylketone, benzophenone) and other photo-initiators of the Irgacure® type available from the company Ciba Geigy; Darocur®1173, 1116, 1398, 1174 and 1020 (available from the company Merck), benzophenone, 2-chlorothioxanthone, 2-methylthioxanthone, 2-isopropylthioxanthone, benzoin, 4,4'-dimethoxybenzoin, benzoin ethylether, benzoin isopropylether, benzildimethylketal, 1,1,1-trichloroacetophenone, diethoxyacetophenone and dibenzosuberone.

As thermal initiators which may be employed organic peroxides in the form of diacylperoxides, peroxydicarbonates, alkylperesters, dialkyl peroxides, perketals, ketone peroxides and alkylhydroperoxides may be envisaged, among others. Specific examples of such thermal initiators are dibenzoyl peroxide, tert-butyl-perbenzoate and azobisisobutyronitrile.

If epoxide rings are present the usual ring-opening catalysts may be present in the preservative fluid, such as tertiary amines (e.g. imidazole and derivatives thereof).

The above initiators are added to the preservative fluid in conventional amounts. For example, to a preservative fluid having a solids content of 30% to 50% by weight initiator in an amount of e.g. 0.5% to 2% by weight (based on the total amount) may be added).

Finally, the preservative fluid preferably contains at least one substance which neutralizes the acid contained in the paper (at least in part), i.e., a deacidifier and/or a buffer. Any compound for the neutralization of acid known to the skilled person may be employed for said purpose, as long as it does not interfere with the reactions to be carried out subsequently (e.g., curing by further condensation, polymerization, etc.). As examples thereof there may be mentioned inorganic and organic bases (e.g. amines), ammonium salts and other salts which give rise to a basic reaction in aqueous solution.

The preservative fluid prepared can be contacted with the paper either as such or after partial or almost complete removal of the solvent employed and the solvents formed during the reaction, respectively, (e.g. the alcohols formed by hydrolysis of the alkoxides) and/or after addition of a suitable solvent in order to lower the viscosity thereof. At the latest prior to the application of the preservative fluid conventional additives (which are not harmful to the paper and the components thereof) may be added thereto, such as, e.g., colorants, antioxidants, levelling agents, UV absorbers and the like.

The preservative fluid optionally (and preferably) provided with an initiator and, optionally, other additives is then brought into contact with the paper, preferably by immersing the paper into the preservative fluid. Prior to the drying and/or curing operation the excess preservative fluid is preferably removed (e.g. by allowing it to drip or by squeezing). The drying operation is carried out at room temperature or at slightly elevated temperature.

Subsequent to the optional drying operation the preservative fluid impregnating the paper may be cured, in a manner known per se, thermally and/or by irradiation, depending on the kind and presence, respectively, of an initiator.

In the case of thermal curing, the curing temperature is preferably at least 50° C., particularly at least 90° C. The maximum curing temperature is determined, i.a., also by the thermal stress the paper to be treated can withstand. Preferably curing temperatures of 180° C. and particularly 150° C. will not be exceeded. The curing time generally is from 1 to 2 hours.

The following examples are to illustrate the present invention.

EXAMPLE 1

To a solution of 55.8 g (0.2 moles) of γ-glycidoxypropyltriethoxysilane and 5.1 g (0.01 moles) of 1H,1H,2H,2H-perfluorooctyltriethoxysilane (FTS) 27 g (1.5 moles) of water were added with stirring, whereafter the reaction mixture was refluxed for 6 hours. To the resultant single-phase solution 20 g (0.08 moles) of bisphenol S were then added, whereafter a dilution with 100, 150 or 200 g of ethanol was carried out. Following the dissolution of bisphenol S, 0.8 g (0.001 moles) of 1-methylimidazole as curing catalyst were added, whereafter the reaction mixture was stirred for 10 minutes. For the coating operation the solution was placed into a crystallizing dish.

Three sheets of paper (10 cm×10 cm) were cut and placed into the sol for 10 minutes and completely covered therewith. Then the sheets of paper were placed between two glass plates (10 cm×10 cm) and freed from excess sol by strongly pressing said glass plates together. The impregnated sheets of paper were then cured between the glass plates in a preheated drying cabinet at 130° C. for one hour.

At the above dilutions the sheets did not stick to each other or to the glass plate.

EXAMPLE 2

Example 1 was repeated, except that no bisphenol S was added.

As a result it was also confirmed that the sheets did not stick to each other or to the glass plate.

EXAMPLE 3

To a solution of 49.7 g (0.2 moles) of 3-methacryloxypropyltrimethoxysilane and 5.1 g (0.01 moles) of FTS 17 g (0.94 moles) of water were added with stirring, whereafter the resultant mixture was heated to reflux for 24 hours. The resulting single-phase solution was diluted with 100, 150 or 200 g of ethanol and thereafter 0.16 g (0.001 moles) of azobisisobutyronitrile (AIBN) as polymerization catalyst were added. The resulting sol was stirred for about 20 minutes whereafter the AIBN had completely dissolved and then the sol was placed into a crystallizing dish for coating purposes. The further procedure was as described in Example 1.

As a result it was confirmed that the sheets did not stick to each other or to the glass plate.

EXAMPLE 4

The procedure of Example 3 was repeated, except that additionally 1.8 g (0.01 moles) of 3-aminopropyltrimethoxysilane were employed and the added amount of water was 17.8 g (0.99 moles).

It was observed that the paper sheets did neither stick to each other nor to the glass plate.

EXAMPLE 5

To a solution of 24 g (0.2 moles) of dimethyidimethoxysilane, 4.36 g (0.02 moles) of methyloctyidimethoxysilane and 5.1 g (0.01 moles) of FTS 12.9 g (0.72 moles) of water and 50 g of ethanol were added with stirring, whereafter heating to reflux was carried out for 6 hours. The resultant single-phase solution was diluted with 50, 100 or 150 g of ethanol and placed in a crystallizing dish for coating purposes. The further procedure was as described in Example 1.

At the given dilutions the sheets did neither stick to each other nor to the glass plate.

EXAMPLE 6

The procedure of Example 5 was repeated, except that additionally 7.2 g (0.04 moles) of 3-aminopropyltrimethoxysilane were employed and the added amount of water was 15.1 g (0.84 moles).

The sheets did neither stick to each other nor to the glass plate.

EXAMPLE 7

A book having leaves the fragility whereof barely allowed them to be turned with care was immersed into a solution prepared as in Examples 1 to 6 and then the solution was allowed to act thereon for about 30 minutes. Thereafter the book was removed from the solution, freed of excess solvent by pressing it by hand and dried in an oven at 60° C. for several hours. The individual book leaves did not stick together. The wet tear strength thereof had quadrupled. The dripping of $H_2SO_4$ thereon did not result in the formation of holes.

What is claimed is:

1. A process for preserving a plurality of paper layers which are in contact with each other at least in partial regions without causing adhesion of the paper layers, comprising (a) impregnating the plurality of paper layers with a preservative fluid comprising polycondensates based on one or more hydrolytically polycondensable compounds of the elements M of the main groups III to V and the sub-groups II to IV of the Periodic Table, where in said polycondensates at least one organic group G which comprises at least two carbon atoms to each of which at least one atom selected from the group consisting of hydrogen and fluorine atoms is bonded and which organic group G has no polar substituents, is bonded, either directly via one of the carbon atoms or via a linking group A, to at least 0.1% of the central atoms M; and (b) drying and/or curing of the plurality of paper layers that have been impregnated with said preservative fluid.

2. A process according to claim 1 wherein the elements M are selected from the group consisting of Si, Al, B, Sn, Zr, V, Zn, and mixtures of said elements.

3. A process according to claim 1 wherein at least 0.5% of the central atoms M are bonded to organic groups G.

4. A process according to claim 1 wherein said organic groups G have at least 3 carbon atoms to each of which at least one atom selected from the group consisting of hydrogen and fluorine atoms is bonded.

5. A process according to claim 1 wherein the groups G are aliphatic groups, which groups may optionally be partially fluorinated.

6. A process according to claim 1 wherein the groups G comprise groups wherein 2 to 30 fluorine atoms are bonded to aliphatic carbon atoms, which carbon atoms, in the case of the direct bonding of the group G, are separated from M by at least 2 atoms.

7. A process according to claim 1 wherein said linking group A forms a chelate complex with M.

8. A process according to claim 1 wherein said linking group A forms a chelate complex with M wherein M is coordinated via at least 2 atoms of said group A, which atoms are selected from the group consisting of oxygen and nitrogen atoms.

9. A process according to claim 1 wherein said linking group A forms a chelate complex with M, said chelate complex having the structure

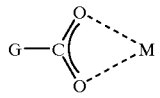

or

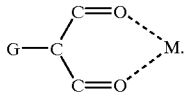

10. A process according to claim 1 wherein, in addition to said groups G, organic groups H are present on the central atoms M, which groups H are different from the groups G.

11. A process according to claim 1 wherein, in addition to said groups G, organic groups H' are present on the central atoms M, said groups H' being capable of undergoing, optionally in the presence of catalysts, a thermal or photochemical curing reaction.

12. A process according to claim 1 wherein, in addition to said groups G, organic groups H' are present on the central atoms M, said groups H' comprising groups having polymerizable carbon-carbon double or triple bonds and/or epoxide rings.

13. A process according to claim 1 wherein, in addition to said groups G, organic groups H' are present on the central atoms M, said groups H' comprising groups having polymerizable carbon-carbon double or triple bonds and/or epoxide rings, and that the preservative fluid additionally contains one or more catalysts selected from the group consisting of thermal polymerization catalysts, photochemical polymerization catalysts, and catalysts for epoxide ring opening polymerization.

14. A process according to claim 1 wherein, in addition to said groups G, organic groups H' are present on the central atoms M, said groups H' comprising groups having polymerizable carbon-carbon double or triple bonds and/or epoxide rings, and that the preservative fluid additionally contains one or more catalysts selected from the group consisting of thermal polymerization catalysts, photochemical polymerization catalysts, and catalysts for epoxide ring opening polymerization, as well as at least one organic compound which can take part in a polymerization reaction.

15. A process according to claim 1 wherein the preservative fluid additionally contains water and/or an organic solvent.

16. A process according to claim 1 wherein the preservative fluid additionally contains a deacidifier and/or a buffer.

17. A process according to claim 1 wherein said contacting is carried out by immersing the paper layers in the preservative fluid.

18. A process according to claim 1 wherein said drying and/or curing operation is carried out in an oven.

19. A process according to claim 1 wherein said plurality of paper layers is a whole book.

20. Preserved paper, obtained according to the process of claim 1.

21. Preserved paper, obtained according to the process of claim 11.

22. Preserved paper, obtained according to the process of claim 12.

23. Preserved paper, obtained according to the process of claim 13.

24. Preserved paper, obtained according to the process of claim 14.

25. A preserved book, obtained according to the process of claim 19.

* * * * *

UNITED STATES PATENT AND TRADEMARK OFFICE

CERTIFICATE OF CORRECTION

PATENT NO. : 6,071,475
DATED : June 6, 2000
INVENTOR(S) : Schmidt et al.

It is certified that error appears in the above-identified patent and that said Letters Patent is hereby corrected as shown below:

Column 1, item [54],
"PROCESS OF PRESERVING PAPER" should read -- PROCESS FOR PRESERVING PAPER --.

Item [73] Assignee,
"Institut für Neue Materialien Gemeinnützige, Saarbrücken, Germany" should read -- Institut für Neue Materialien Gemeinnützige GmbH, Saarbrücken, Germany --.

Signed and Sealed this

Second Day of October, 2001

*Attest:*

Nicholas P. Godici

NICHOLAS P. GODICI
*Acting Director of the United States Patent and Trademark Office*

*Attesting Officer*